US005464947A

United States Patent [19]

Kitamura

[11] Patent Number: 5,464,947

[45] Date of Patent: Nov. 7, 1995

[54] APPARATUS FOR AND METHOD OF PRODUCING FLUCTUATIONS IN SOUND FOR ELECTRONIC SOUND SYSTEM

[75] Inventor: Mineo Kitamura, Hamamatsu, Japan

[73] Assignee: Kawai Musical Inst. Mfg. Co., Ltd., Japan

[21] Appl. No.: 172,146

[22] Filed: Dec. 23, 1993

[30] Foreign Application Priority Data

Dec. 25, 1992 [JP] Japan ..... 4-0346063

[51] Int. Cl.[6] ..... G10H 1/057; G10H 1/06

[52] U.S. Cl. ..... 84/624; 84/627; 84/658; 84/663; 84/696

[58] Field of Search ..... 84/615, 622–633, 84/658–665, 696

[56] References Cited

U.S. PATENT DOCUMENTS 4,706,537 11/1987 Oguri ..... 84/622 X 4,794,480 7/1987 Suzuki ..... 84/622 X 5,166,464 11/1992 Sakata et al. ..... 84/662

*Primary Examiner*—Stanley J. Witkowski

[57] ABSTRACT

According to the invention, a plurality of pieces of frequency modulation information are weighted independently and then synthesized. The individual pieces of synthesized frequency modulation information are weighted independently, and individual pieces of sound data that have been generation speed controlled according to the individual pieces of frequency modulation information are synthesized. In this way, the individual pieces of frequency modulation information are weighted independently. Thus, the individual weighting processes may be changed in various ways without mutual restriction to produce for various changes in the frequency modulation.

24 Claims, 14 Drawing Sheets

FIG. 3

38

| | |
|---|---|
| REGISTER MW1 | MODULATION DATA FM1, AM1 (SAWTOOTH WAVE) |
| REGISTER MW2 | MODULATION DATA FM2, AM2 (CHOPPING WAVE) |
| REGISTER MW3 | MODULATION DATA FM3, AM3 (SINE WAVE) |
| REGISTER W1 | FREQUENCY WEIGHTING DATA WT1 |
| REGISTER W2 | FREQUENCY WEIGHTING DATA WT2 |
| REGISTER W3 | FREQUENCY WEIGHTING DATA WT3 |
| REGISTER W4 | AMPLITUDE WEIGHTING DATA WT4 |
| REGISTER W5 | AMPLITUDE WEIGHTING DATA WT5 |
| REGISTER W6 | AMPLITUDE WEIGHTING DATA WT6 |
| REGISTER MS1 | SUM FREQUENCY MODULATION DATA SFM |
| REGISTER MS2 | SUM AMPLITUDE MODULATION DATA SAM |
| REGISTER FN1 | FREQUENCY NUMBER DATA FN |
| REGISTER FN2 | ACCUMULATED FREQUENCY NUMBER DATA AFN |

MOD. : MODULATION
WGH. : WEIGHTING
FRQ. : FREQUENCY
AMP. : AMPLITUDE

FM1~FM3 : FRQ. MOD. DATA
AM1~AM3 : AMP. MOD. DATA
WT1~WT6 : WGH. DATA

APPARATUS FOR AND METHOD OF PRODUCING FLUCTUATIONS IN SOUND FOR ELECTRONIC SOUND SYSTEM

FIELD OF THE INVENTION

This invention relates to a system for producing fluctuations (waverings, swings, sways) in sound (acoustic) for use in an electronic sound (acoustical) system and, more particularly, to a method of varying fluctuations in frequency modulation or the like.

DESCRIPTION OF THE PRIOR ART

Heretofore, fluctuations in sound, for instance the frequency of music in the case of frequency modulation, are produced to realize various musical effects. Among the musical effects are vibrato, glide, portamento, tremolo, etc. The ribtaro effect is obtainable by periodically changing the frequency of music. For example, sine or chopping (triangle) wave modulation data with an amplitude of 25 cents and a frequency of 6 to 8 Hz is synthesized (combined) with the read-out address data of musical waveform data. The glide effect is obtainable by causing gradual changes in the frequency of music. For example, at the time of a key-"on", semitone modulation data is synthesized with the read-out address data of musical waveform data, and the magnitude of the modulation data is gradually changed to approach "0" with a lapse of time.

As a system for realizing such frequency modulation, the applicant has filed a Japanese patent application entitled "A Device for Frequency Modulation of Musical Tones of an Electronical Musical Instrument" (U.S. patent application Ser. No. 09/473,637). In this application, in a modulating operation circuit 33 shown in FIG. 18A, selectors 350, 351, 357 and 358 select modulation speed data MSPD and modulation depth data MDEP of current and next phases. These data MSPD and MDEP are multiplied by weighting data R and complementary weighting data (1–R) in multipliers 353, 354, 359 and 360, and the outputs thereof are added in adders 356 and 361. In this way, modulation information of the current and next phases is weighted. As the weighting data R and (1–R), high order parts of phase speed accumulation data PSACC are used, as shown in FIG. 21. As the data PSACC is incremented, the weighting is shifted from one side to the other with a lapse of time. Thus, the weighting is shifted progressively and changed from one phase frequency modulation information to next phase frequency modulation information.

In the frequency modulation in the above application, the weighting of two pieces of frequency modulation information is shifted between adjacent phases. In contrast, it is an object of the present invention to permit, instead of such a weighting shift, each weighting independently, thus producing various changes in the weighting itself to produce various changes in the frequency modulation. Another object of the invention is to permit, instead of a frequency modulation information shift between adjacent phases, weighting of each frequency modulation information independently, thus permitting weighting of three or more pieces of frequency modulation information to produce various changes in the frequency modulation.

SUMMARY OF THE INVENTION

According to the invention, a plurality of pieces of frequency modulation information are weighted independently and then synthesized (combined), and the speed of sound (acoustical) data generation is controlled according to the resultant frequency modulation information. Also, a plurality of pieces of frequency modulation information are weighted independently, and individual sound data with the generation speed thereof controlled according to the weighted pieces of frequency modulation information are synthesized. Since the individual pieces of frequency modulation information are weighted independently, the individual weighting operations can be changed in various ways without mutual restriction, thus permitting the frequency modulation to be changed in various ways.

BRIEF DESCRIPTION OF THE DRAWINGS

FIG. 3 is a view showing various registers in a data RAM 38 in the digital signal processor 11;

DETAILED DESCRIPTION OF THE PREFERRED EMBODIMENTS

SUMMARY OF THE EMBODIMENT

Figure 11:
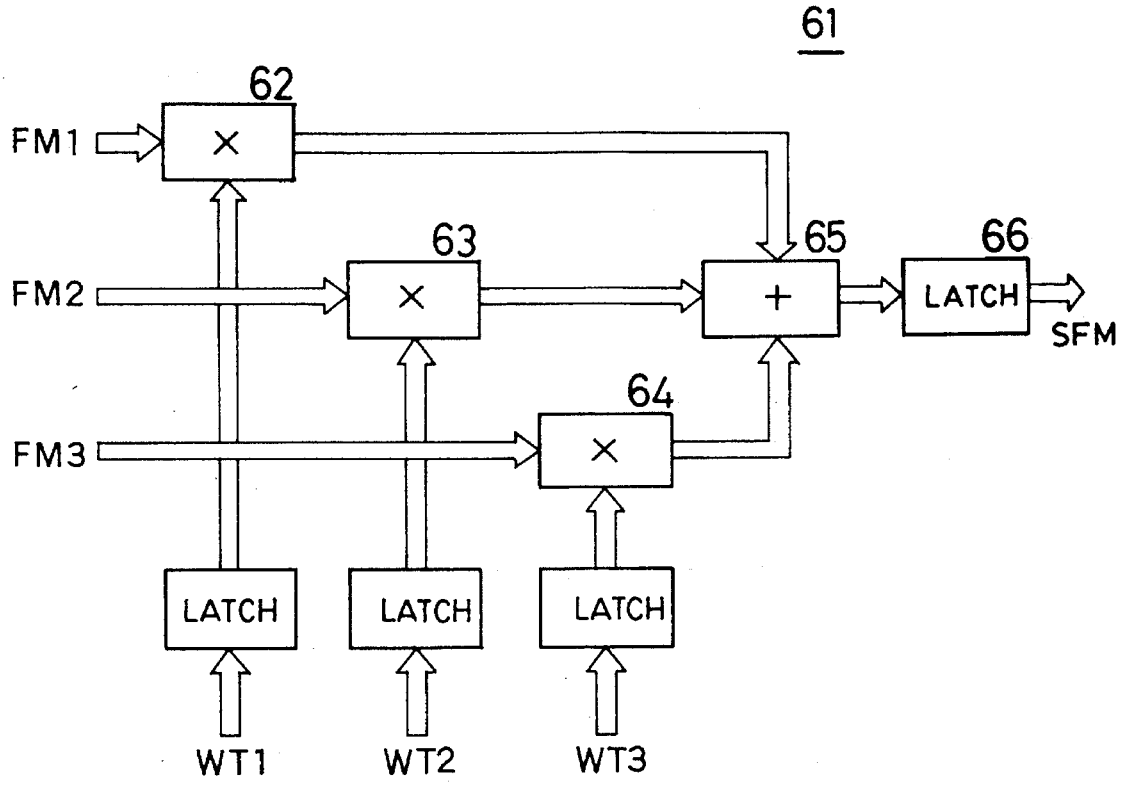
FIGS. 11(*a*) and (*b*) is a circuit diagram showing a weighting/modulating circuit 61.
Figure 11:
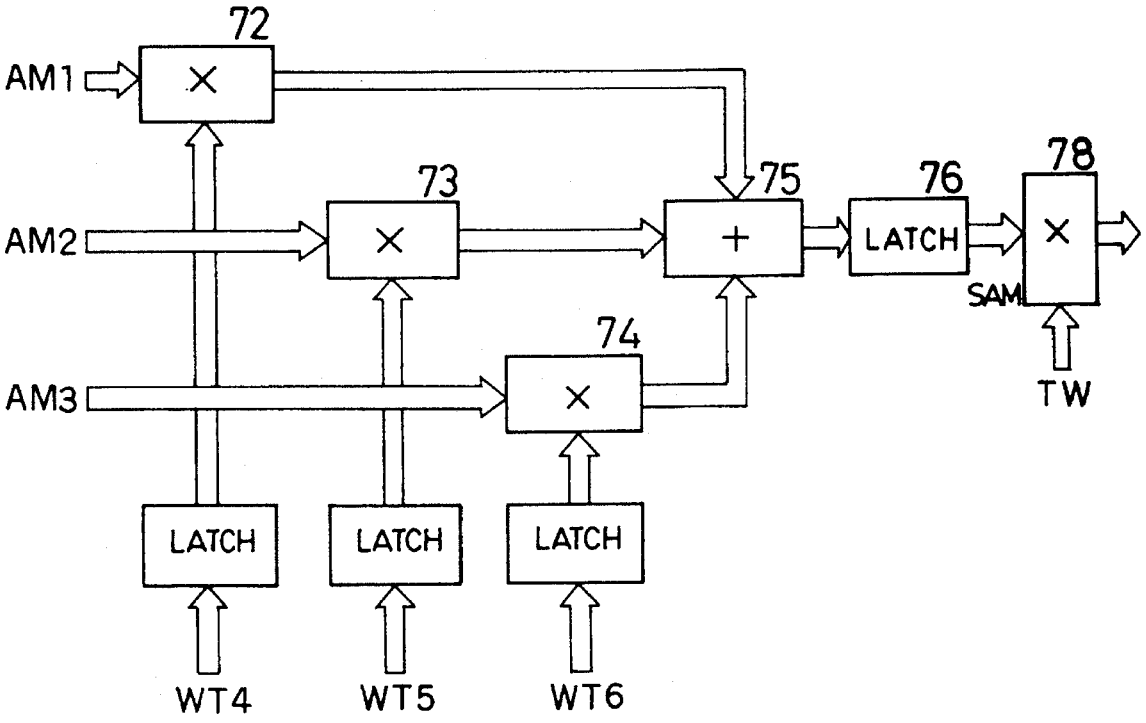

Sawtooth, chopping (triangle) and sine wave modulation data FM1 to FM3 are weighted by being multiplied by weighting data WT1 to WT3 in multipliers 62 to 64 shown in FIG. 11, and the outputs thereof are synthesized (combined) in an adder 65 to be output as sum frequency modulation data SFM. The modulation data AM1 to AM3 are weighted by being multiplied by weighting data WT4 to WT6 by multipliers 72 to 74 to be output as sum (synthesized) amplitude modulation data SAM.

1. Overall circuit

Figure 1:
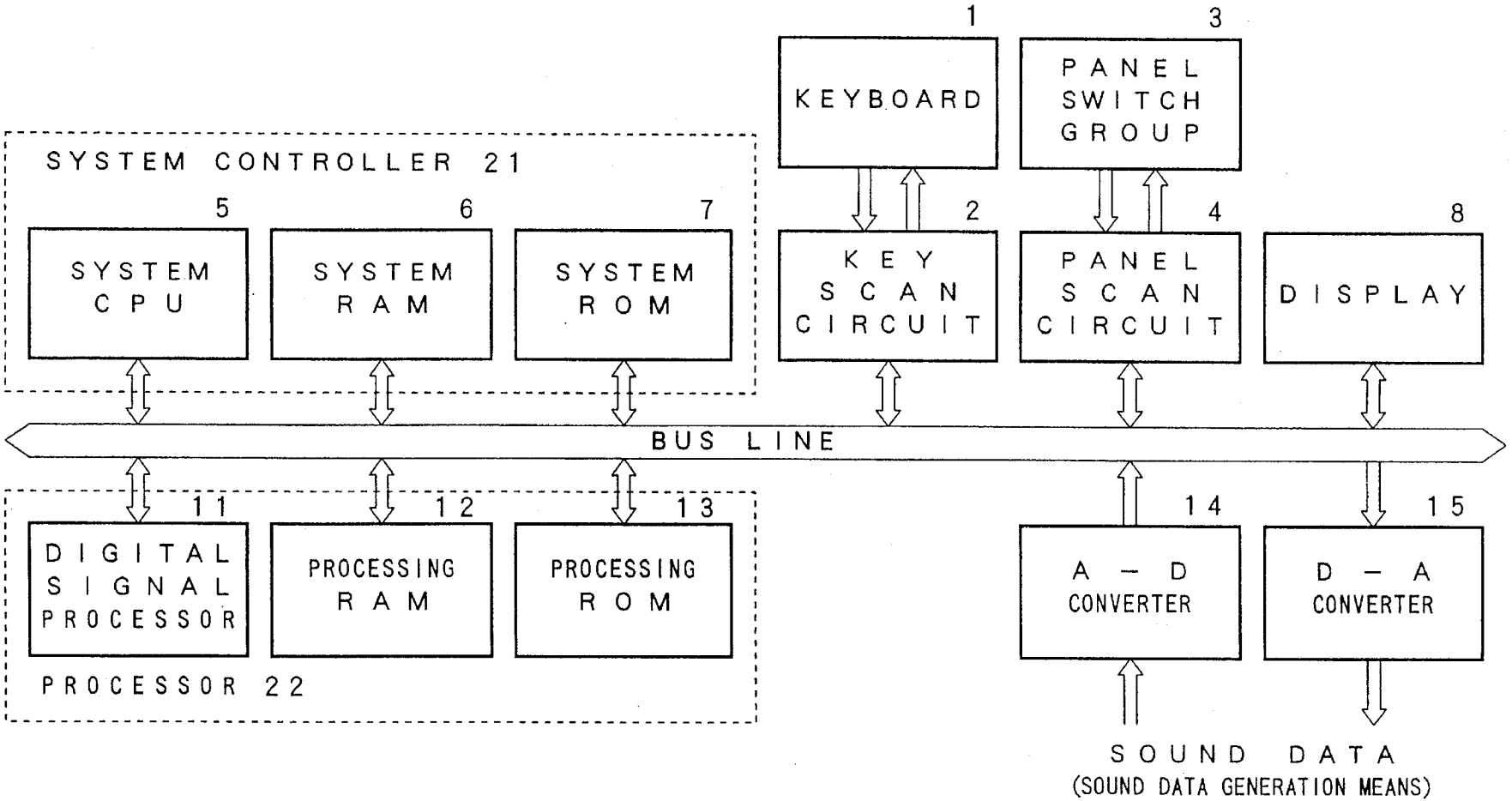
FIG. 1 is a block diagram showing an electronic sound system.

FIG. 1 shows the overall circuit of an electronic sound (acoustical) system. A keyboard 1 has keys for turning on and off musical sounds (or tones). A key scan circuit 2 scans these keys to detect key operation, i.e., key-"on" and key- "off" data. These data are written in a system RAM 6 by a system CPU 5. The system CPU 5 compares these written data with key state data representing the on/off state of the individual keys, which have been stored in the system RAM 6, thus judging the "on" event, "off" event and key number of each key.

The keyboard 1 may be replaced with an electronic string instrument, an electronic wind (reed) instrument, an electronic percussion (pad) instrument, a computer keyboard, etc. In the keyboard 1 and key scan circuit 2, touch data is detected as well as the key-"on", key-"off" and tone pitch.

A panel switch group 3 has switches which are scanned by a panel switch scan circuit 4. with this scan, data representing the on/off state of the switches are detected. These data are written in the system RAM 6 by the system CPU 5. The system CPU 5 compares the written data with data representing the on/off state of the switches, which have been stored in the system RAM 6, thus judging the "on" event and "off" event of the switches.

The panel switch group 3 includes operators for specifying frequency modulations such as bender, vibrato, glide, portamento, tremolo, etc., and also operators for specifying effects such as reverberation, feather, celesta, mandolin, sustain, etc. The panel switch group 3 can further designate tone Colors (i.e., tone number data TN) and also switching of various modes. On a display 8, the contents of designation of the effects, modes, tone colors can be displayed according to the contents stored in the system RAM 6.

In the system RAM 6 are stored various data to be processed by the system CPU 5 and various data necessary for the processing. In a system R0M 7 are stored programs to be executed by the system CPU 5 and those for other processes. The system CPU 5, system RAM 6 and system R0M 7 constitute a system controller 21, for instance a one-chip microcomputer.

A digital signal processor 11 performs operational processing to generate various data on a time division basis. These data are frequency modulation data, amplitude modulation data, weighting data, address data, tone waveform data, envelope data, filter characteristic data, etc. In a processing ROM 13 are stored programs for operational processes to be executed in the digital signal processor 11, as corresponding to flowcharts to be described later, and those for other processes. In a processing RAM 12 are stored tone waveform data TW, various data to be processed in the digital signal processor 11 and various data necessary for the processing. The digital signal processor 11, processing RAM 12 and processing ROM 13 constitute a processor 22, fOE instance a one-chip LSI.

To an A-D converter 14, analog tone waveform data TW and other analog signals are input for digital conversion. Digital tone waveform data TW that have been obtained through the conversion are written in the processing RAM 12 and digital signal processor 11. The tone waveform data TW in the processing RAM 12 are read out by the digital signal processor 11 to be supplied to a D-A converter 15. To the D-A converter 15, digital tone waveform data TW and other digital data are input for conversion to analog data.

Figure 12:
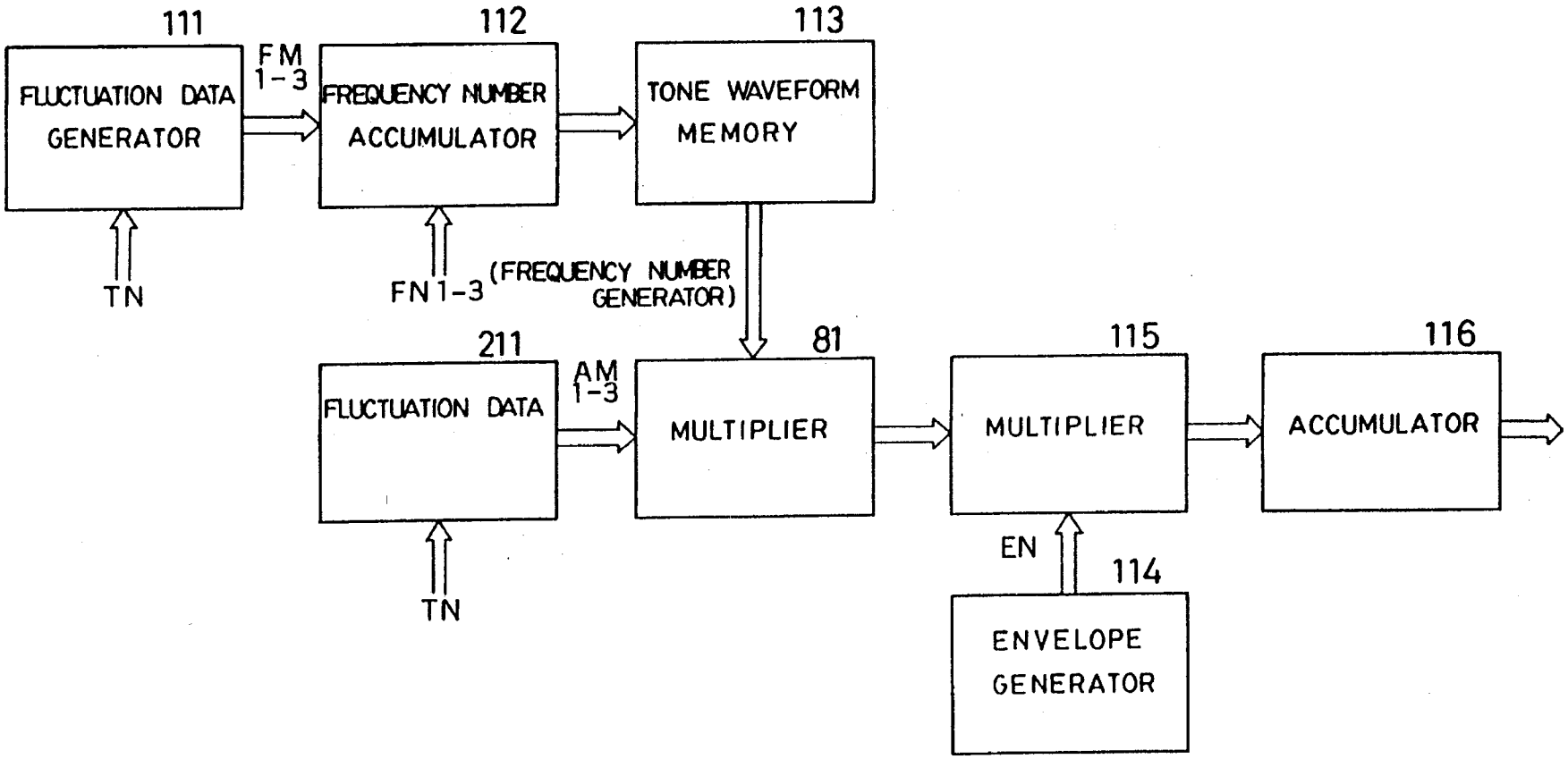
FIG. 12 is a block diagram showing the entire circuitry of a second embodiment.

The electronic sound system shown in FIG. 1 may include a tone generator as shown in FIG. 12. The tone generator polyphonically sounds a plurality of tones on a time division basis. In this case, data from the digital signal processor 11 are supplied as fluctuation (wavering, swing, sway) data to a frequency number accumulator 112, an envelope generator 114 and an accumulator 116.

2. Digital signal processor 11

Figure 2:
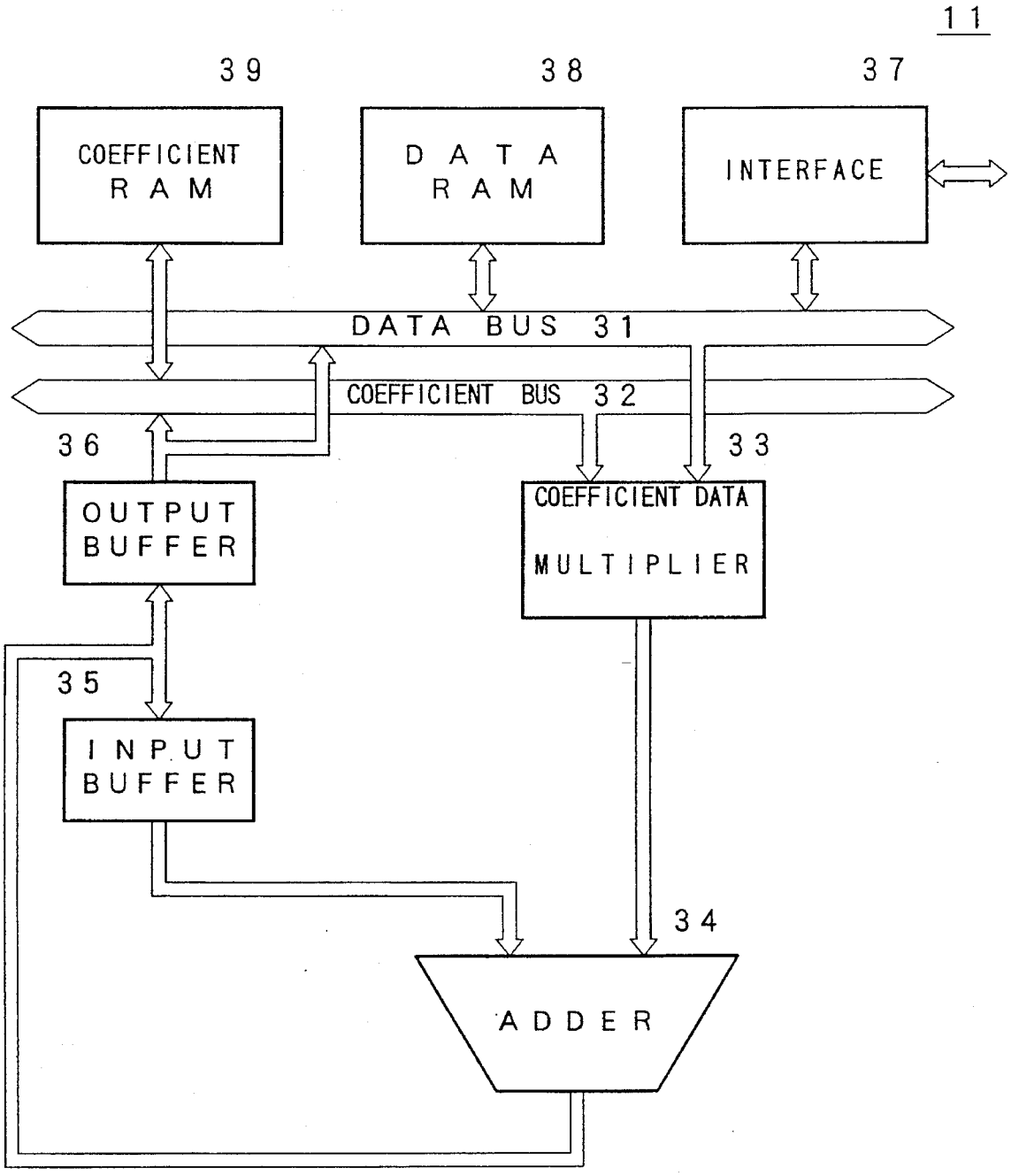
FIG. 2 is a block diagram showing a digital signal processor 11.

FIG. 2 shows the circuit of the digital signal processor 11. The digital signal processor 11 includes a data bus line 31 and a coefficient bus line 32. To the data bus line 31, data from an output-buffer 36, a data RAM 38 and an interface 37 are supplied. To the coefficient bus line 32, coefficient data from the output-buffer 36 or the coefficient RAM 39 are supplied. The coefficient data are step data ST, frequency number data, etc., for operative processing various data in the digital signal processor 11, and are stored in programs in the processing ROM 13.

Data supplied to the data bus line 31 and coefficient data supplied to the coefficient bus line 32 are multiplied by one another in a multiplier 33, the output of which is added to data from an input-buffer 35 in an adder 34. The output of the adder is written in the output- and input-buffers 36 and 35. Data from the output-buffer 36 is supplied to the data or coefficient bus line 31 or 32. Data from the data bus line 31 is output via an interface 37, or supplied to the multiplier 33, or supplied to the data RAM 38. Data in the coefficient bus line 32 is supplied to the multiplier 33 or to the coefficient RAM 39.

3. Register group

FIG. 3 shows a register group in the data RAM 38 in the digital signal processor 11. In registers MW1 to MW3, a sawtooth, a chopping (triangle) and a sine frequency or amplitude modulation data FM or AM are stored. In registers W1 to W3, frequency weighting data WT1 to WT3 corresponding to the frequency modulation data FM are stored. In registers W4 to W6, amplitude weighting data WT4 to WT6 corresponding to the amplitude modulation data AM are stored. The weighting data WT1 to WT6 are rewritten in an interrupt process by the system CPU 5, and thus are changed with the lapse of time. In registers MS1 and MS2 sum (synthesized) frequency and amplitude modulation data SFM and SAM obtained as a result Of the weighting are stored. In the registers FN1 and FN2, frequency number data FN and accumulated frequency number data AFN obtained as a result of accumulation of frequency modulation data FM are stored.

4. Overall routine of digital signal processor 11

Figure 4:
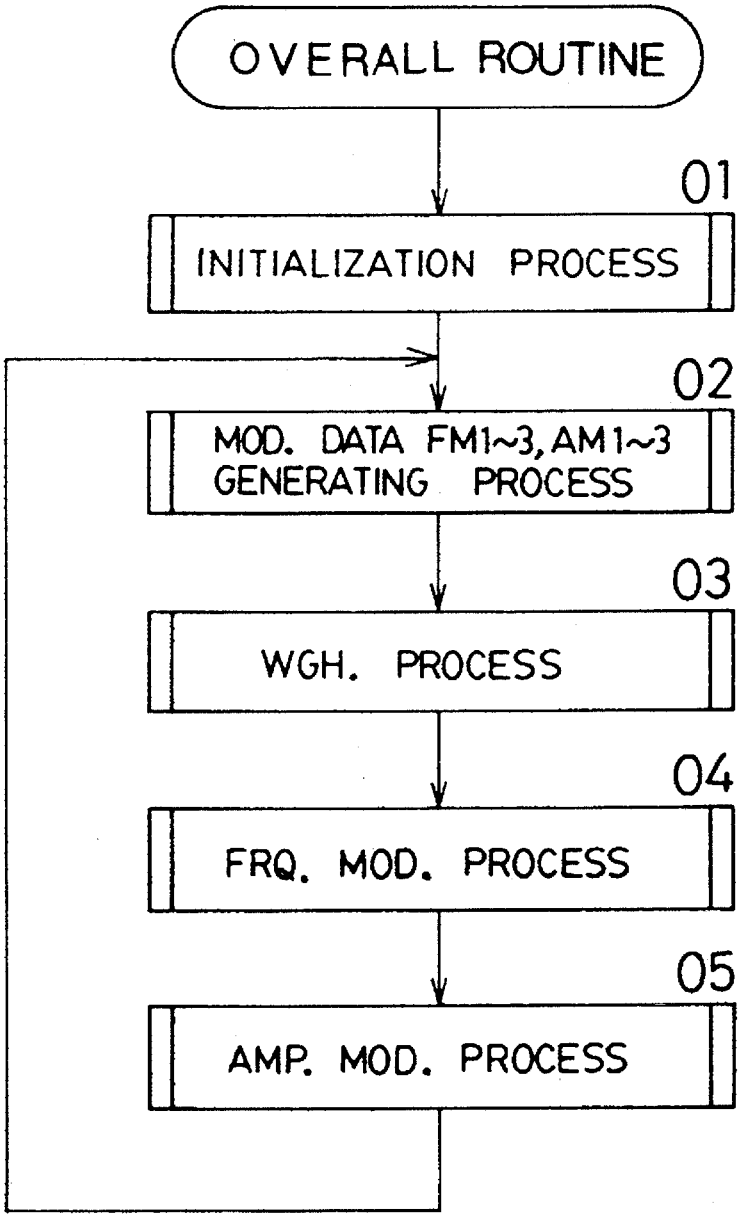
FIG. 4 is a flowchart showing the overall operation of the digital signal processor 11.

FIG. 4 is a flowchart showing the overall routine of the digital signal processor 11. This routine is started with the application of power or turning-on of a predetermined switch. First, the digital signal processor 1 1 executes an initialization process (step 01). Then, amplitude and frequency modulation data AM1 to AM3 and FM1 to FM3 are generated (step 02). Then, these frequency and amplitude modulation data FM1 to FM3 and AM1 to AM3 are weighted (step 03). Then, a frequency modulation process is executed, that is, the weighted frequency modulation data FM1 to FM3 and read-out address data RAD are synthesized (combined) (step 04). Then, an amplitude modulation process is executed, that is, tone waveform data TW read out according to the resultant read-out address data RAP and the amplitude modulation data AM1 to AM3 are synthesized (step 05). The individual processes will now be described in detail.

The initialization process in the step 01 is carried out as follows. Step data ST and data "1 (00 . . . 001)", "–1 (11 . . . 111)", "–MAX/2", "2 (00 . . . 010)" and "1/A" are read out from the processing ROM 13 and written through the interface 37, multiplier 33, adder 34 and output-buffer 36 in the coefficient RAM 39. In this case, the data "1" is stored in address "0", and the data "–1" is stored in address "1". The step data ST is for the step of generating the modulation data FM1 and AM1. The data "MAX" represents the maximum value of the process data in the digital signal processor 11. The data "1/A" represents a control value for shaping such as to let the maximum value of the accumulation of the modulation data FM3 and AM3 to be described later be the maximum amplitude.

Further, in the initialization process in the step 01, the six weighting data WT1 to WT6 which are supplied from the CPU 5 through the interface 37, are written progressively through the multiplier 33, adder 34 and output-buffer 36 in registers W1 to W6 of the data RAM 38, Furthermore, in the initialization process in the step 01, the frequency number data FN corresponding to the key number data KN is written from the system CPU 5 through the interface 37 in the register FN1 of the data RAM 38. The frequency number data FN is obtained as a result of conversion of key number data KN corresponding to on-key data from the keyboard 1, MIDI data and auto play data in a frequency ROM (not shown), etc.

In this overall routine, the tone waveform generation process for generating the tone waveform data TW may be executed before the step 02. The process in the steps 02 to 05 is repeated. In this repeating, it is possible to detect the value of a time counter (not shown) after the step 05, wait until the value of the time counter reaches a predetermined value, then clear the time counter and then return to the step 02.

5. Process of generating frequency and amplitude modulation data FM and AM

Figure 5:
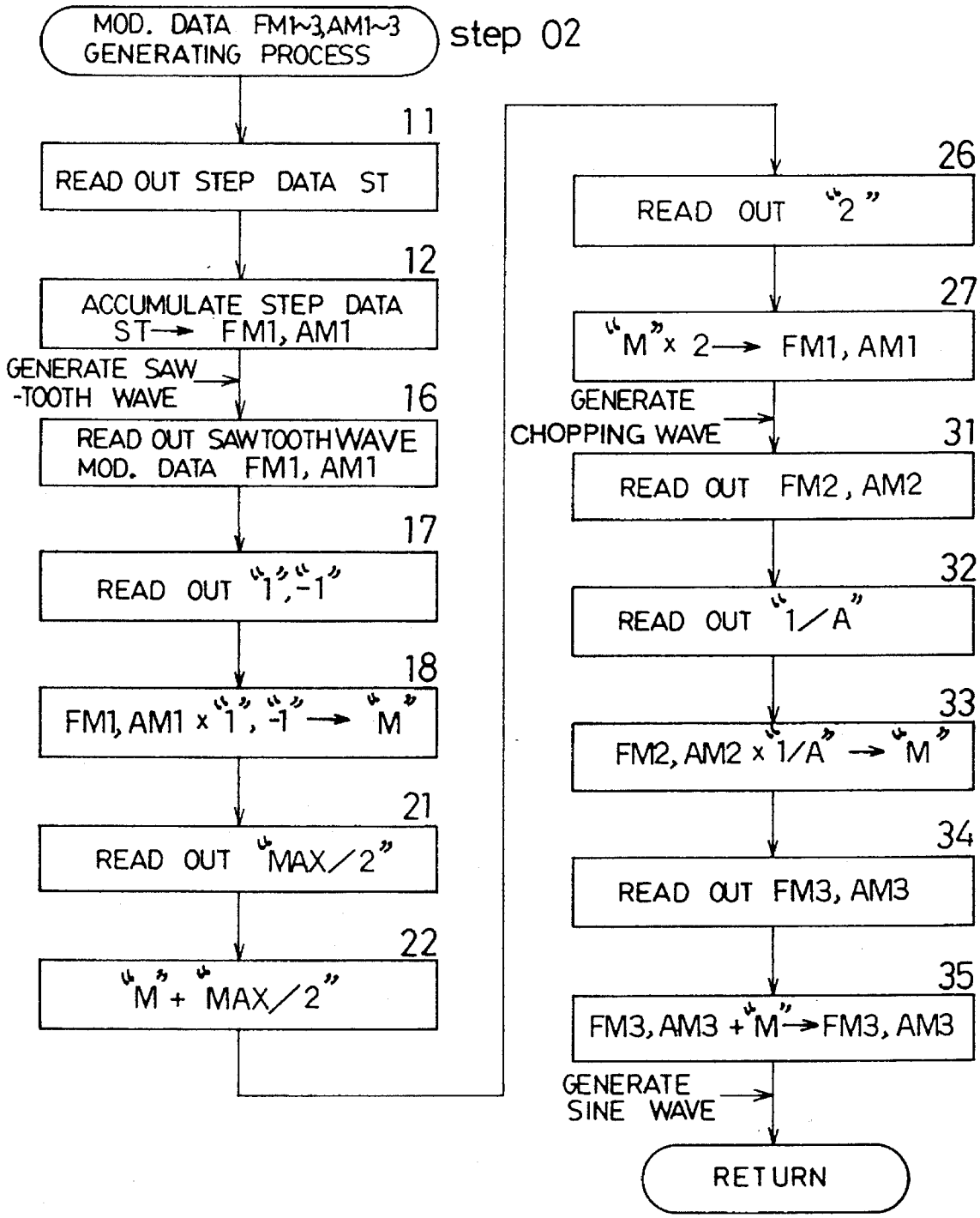
FIG. 5 is a flowchart showing the operation of generating frequency modulation data FM and amplitude modulation data AM in a step 02.

FIG. 5 shows a flowchart of the routine for generating the frequency and amplitude modulation data FM1 to FM1 and AM1 to AM3 in the step 02. First, the step data ST is read out from the coefficient RAM 39 and written through the multiplier 33 and adder 34 in the input-buffer 35 (step 11). Then, the step data ST is read out again form the coefficient RAM 39 to be coupled through the multiplier 33 to the adder 34 so as to be added to the step data ST from the input-buffer 35, the output of which is written through the output-buffer 36 in the register MW1 of the data RAM 38 (step 12). The process in the steps 11 and 12 is repeated as shown in FIG. 4. Thus, the step data ST is accumulated in the register MW1 in the data RAM 38, and sawtooth wave modulation data FM1 and AM1 are stored.

Then, the sawtooth wave modulation data FM1 and AM1 are read out from the register MWl in the data RAM 38 and written through the multiplier 33 and adder 34 in the input- and output-buffers 35 and 36 (step 16). Then, the data "1" or "−1" is read out from the coefficient RAM 39 with the sign bit, i.e., the most significant bit, of the modulation data FM1 and AM1 as address data (step 17). Then, the tone waveform data TW in the output-buffer 36 is multiplied by the data "1" or "−1" in the multiplier 33, and the output thereof is set in the input- and output-buffers 35 and 36 (step 18). Thus, if the sawtooth wave modulation data FM1 and AM1 are negative, that is, if their sign bit is "−1", they are multiplied by "−1" and thus made positive, thus generating positive chopping modulation data.

Then, data "MAX/2" is read out from the coefficient RAM 39 (step 21) and added through the multiplier 33 to the adder 34 to the modulation data M from the input-buffer 35, and the output thereof is set in the input- and output-buffers 35 and 36 (step 22). Thus, the positive chopping wave modulation data M is converted to small chopping wave modulation data M having a negative value as well.

Further, data "2" is read out from the coefficient RAM 39 (step 26), and the modulation data M in the output-buffer 86 is multiplied in the multiplier 83 by the data "2", and the resultant data is set in the input- and output-buffers 85 and 86 and written in the register MW2 of the data RAM 38 (step 29). In this way, chopping modulation data FM2 and AM2 with double the amplitude of the small chopping wave modulation data M are generated. The process in the steps 16 to 29 is repeated as shown in FIG. 4. Actually, the above positive chopping, small chopping and chopping modulation data M are realized through the repeating of the process in the steps 16 to 2'9, and chopping modulation data FM2 and AM2 are stored in the register M2 of the data RAM 38.

Then, the chopping modulation data FM2 and AM2 in the register MW2 of the data RAM 38 are read out and set through the multiplier 33 and adder 34 in the input- and output-buffers 35 and 36 (step 31). Then the data "1/A" is read out from the coefficient RAM 39 (step 32.), and the modulation data FM2 and AM2, in the output-buffer 86 are multiplied in the multiplier 33 by the data "1/A". The resultant data is set in the input- and output-buffers 35 and 36 (step 33).

Then, the modulation data FM3 and AM3 in the register MW3 of the data RAM 88 are read out (step 34) and added through the multiplier 33 in the adder 34. The modulation data FM3 and AMS are thus accumulated in the adder 34 to the modulation data FM2 and AM2 from the input-buffer 35. The resultant data is set in the output-buffer 36 and the input-buffer 35 and set in the register MW3 of the data RAM 38 (step 35). The modulation data FMS and AMS that are read out in the step 84 are initially "0".

In this way, the chopping modulation data FM2 and AM2 are accumulated, i.e., integrated, to generate the sine wave modulation data FM3 and AM3. The data "1/A" is a control value for shaping such that the maximum value of the accumulation represents the maximum amplitude. The process in the steps 31 to 35 is repeated as shown in FIG. 4. Actually, the sine wave modulation data FM3 and AM3 are realized through the repeating of the process in the steps 31 to 35, and they are stored in the register MW3 of the data RAM 38.

It is possible to generate the sawtooth, chopping and sine wave modulation data M independently in three digital signal processors 11 instead of generating them in the single digital signal processor 11. Further, it is possible to generate rectangular waves of waves synthesized from the above waves of other waves as the modulation data FM1 to FM3 and AM1 to AM3.

6. process of generating rectangular wave modulation data M

Figure 6:
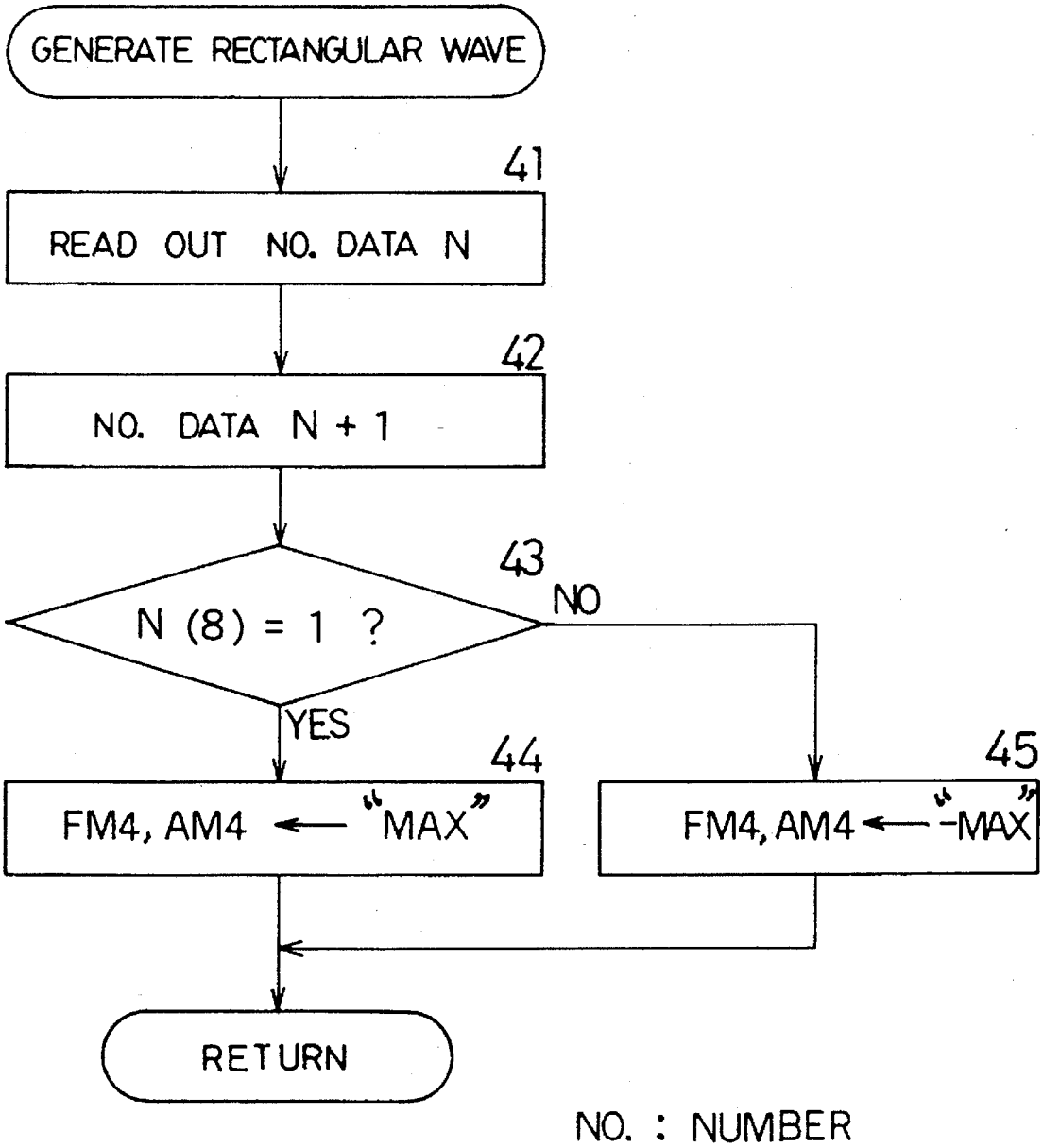
FIG. 6 is a flowchart showing the operation of generating rectangular wave modulation data M.

FIG. 6 is a flowchart showing the routine of generating the rectangular wave modulation data FM4 and AM4. In the generation of the rectangular wave modulation data FM4 and AM4, in the initialization process of the step 01 the data "MAX" and "−MAX" are written in the coefficient RAM 39, and the number data N in the coefficient RAM 39 is cleared. Then, this number data N is read out and set through the multiplier 33 and adder 34 in the input- and output-buffers 35 and 36 (step 41).

The number data N from the input-buffer 35 is incremented by +"1" in the adder 34 (step 42). If predetermined bits of the number data N are "1"(step 43), the data "MAX" is set through the multiplier 33, addend 34 and output-buffer 36 in the register MW4 of the data RAM 38 (step 44). Otherwise (step 43), the data "−MAX" is written through the multiplier 33, adder 34 and output-buffer 36 in the register MW4 (not shown) of the data RAM 38 (step 45).

The check in the step 43 is done as follows. In the above predetermined bits are 4 bits, for instance, the adder 34 executes a calculation "N −MAX+15 (1111)", and bits other than the lower four bits are cleared. The result is multiplied in the multiplier 33 by the data "1/8". If the data is "1" of above, that is, if the lowermost bit is "1", the data "MAX" is read out. If the data is less than "1", that is, if the data is "0", the data "−MAX" is read out.

Figure 13:
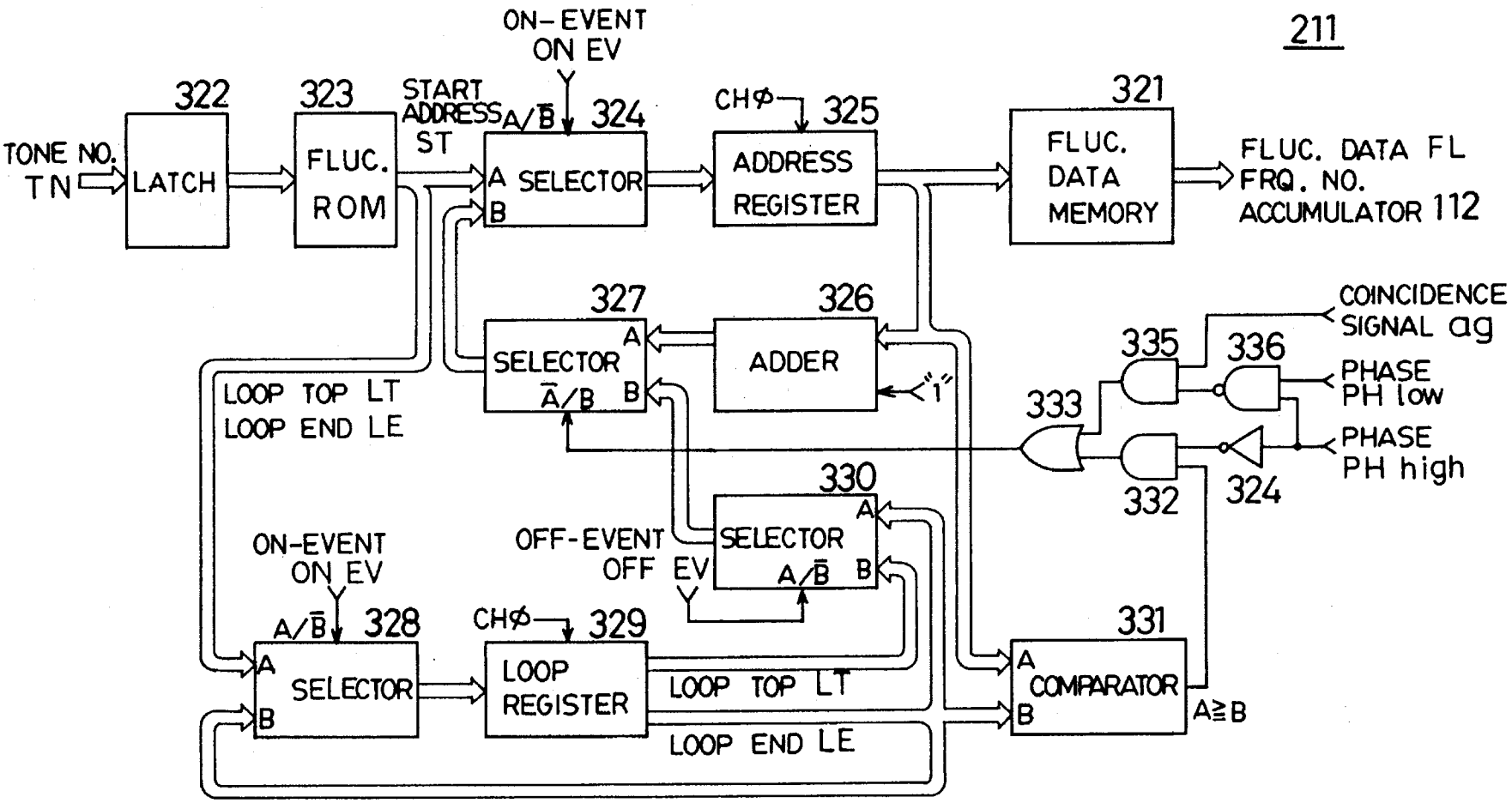
FIG. 13 is a circuit diagram showing a fluctuation generator 211.
Figure 14:
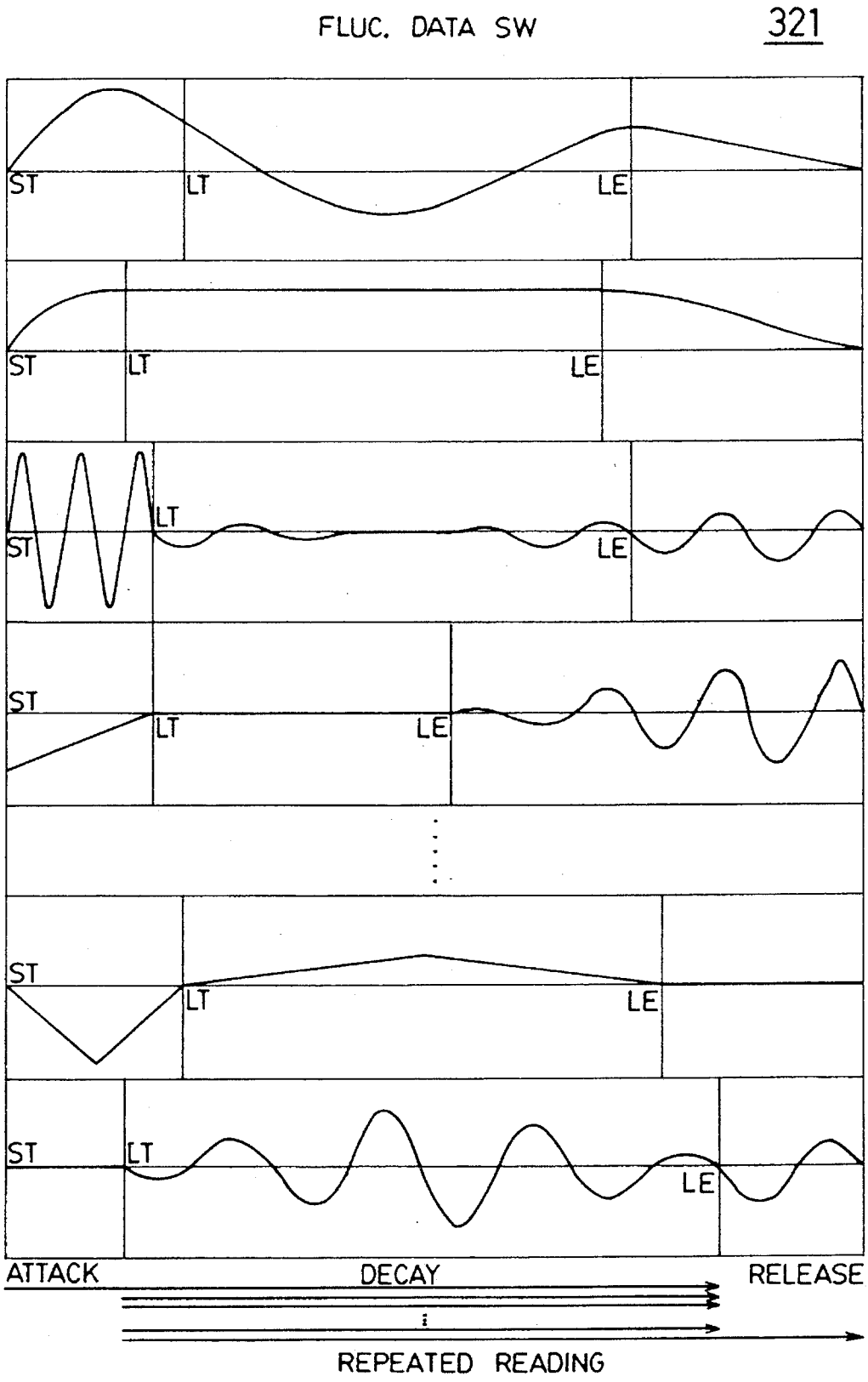
FIG. 14 is a view showing a plurality of fluctuation data FL.

It is possible to use circuits shown in FIGS. 12 to 14 in lieu of the process of generating the frequency and amplitude modulation data FM and AM in the step 02 (21 to 45). In this case, the fluctuation data FL is read out from the fluctuation data memory 321 in the fluctuation data generator 211 on a time division basis or not on any time division basis.

7. Process of weighting frequency and amplitude modulation data FM and AM

Figure 7:
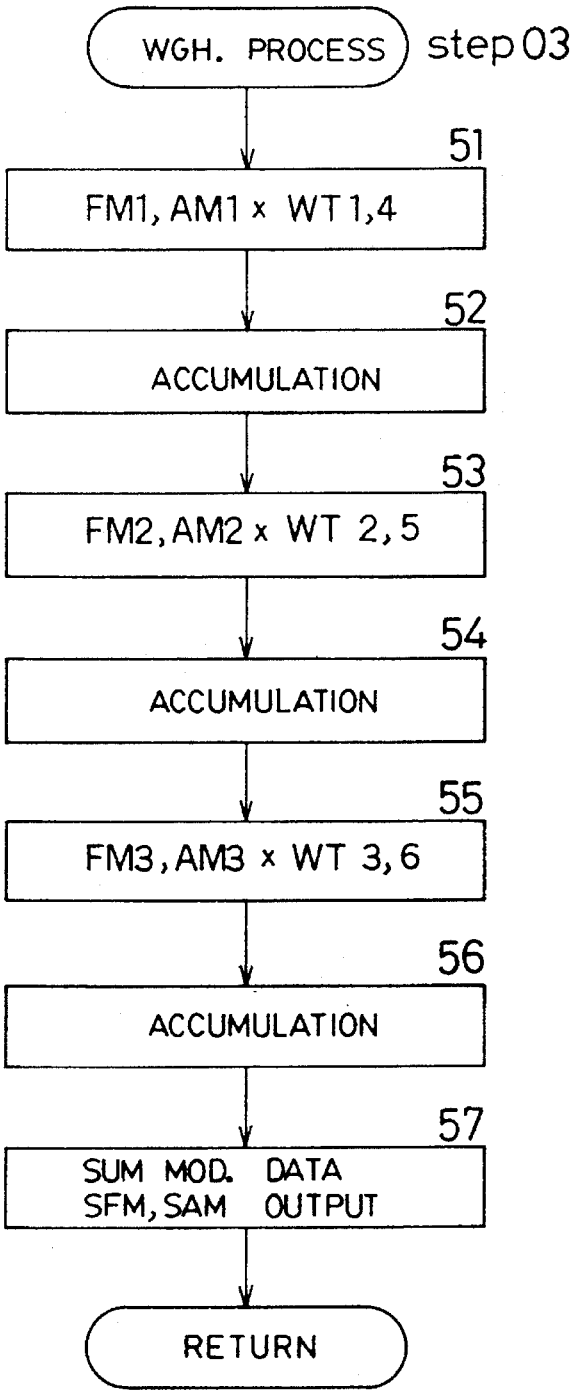
FIG. 7 is a flowchart showing the operation of weighting frequency modulation data FM and amplitude modulation data AM in a step 03.

FIG. 7 is a flowchart showing the routine of weighting the frequency and amplitude modulation data FM1 to FM3 and AM1 to AM3 in the step 03. The sawtooth wave modulation data FM1 and AMI in the register MW1 of the data RAM 38 and the weighting data WT1 and WT4 in the registers W1 and W4 are read out and multiplied by the multiplier 33 (step 51), and the output thereof is set through the adder 34 in the input- and output-buffers 35 and 36 (step 52).

Then, the chopping modulation data FM2 and AM2 and the weighting data WT2 and WT5 are similarly read out and multiplied (step 53), and the resultant data is accumulated to the data in the input- and output-buffers 35 and 36 (step 54). Also, the sine wave modulation data FM3 and AM3 and the weighting data WT3 and WT6 are similarly read out and multiplied (step 55), and the resultant data is accumulated in the input- and output-buffers 35 and 36 (step 56). The sum (synthesized) frequency modulation data SFM that is obtained as a result of the accumulation in the output-buffer 36, is set in the register MS1 of the data RAM 38 (step 57).

This data may be replaced with data obtained as a result of multiplication synthesis. The weighting of the modulation data FM1 to FM3 AM1 to AM3 may be made, in addition to the multiplication by the weighting data WT1 to WT6, a bit shift corresponding to the weighting data WT1 to WT6, division, addition and subtraction, operation based on an operation formula, average calculation, a process with ones of bits as a high bit group and others as a low bit group, etc.

The steps 51 to 57 are repeated as shown in FIG. 4. The weighting of the individual modulation data FM1 to FM3 and AM1 to AM3 is repeated. The weighting data WT1 to WT6 are stored in the system R0M 7 as values which are changed with the lapse of time, and in an interruption process that is executed in the system CPU 5 for each constant cycle they are read out and supplied to the digital signal processor 11. However, it is possible to store these data in the processing R0M 13 to be transferred to the coefficient RAM 39 in the initialization process in the step 01.

The weighting data WT1 to WT6 may have values which are fixed and not changed. The weighting data WT1 to WT6 may be generated by calculations like those in the steps 11 to 45. Further, it is possible to store the weighting data WT1 to WT6 in the fluctuation data memory 321 in the fluctuation data generator 211 as shown in FIGS. 12 to 14 and read out these data on a time division basis or not on any time division basis.

8. Process of frequency modulation

Figure 8:
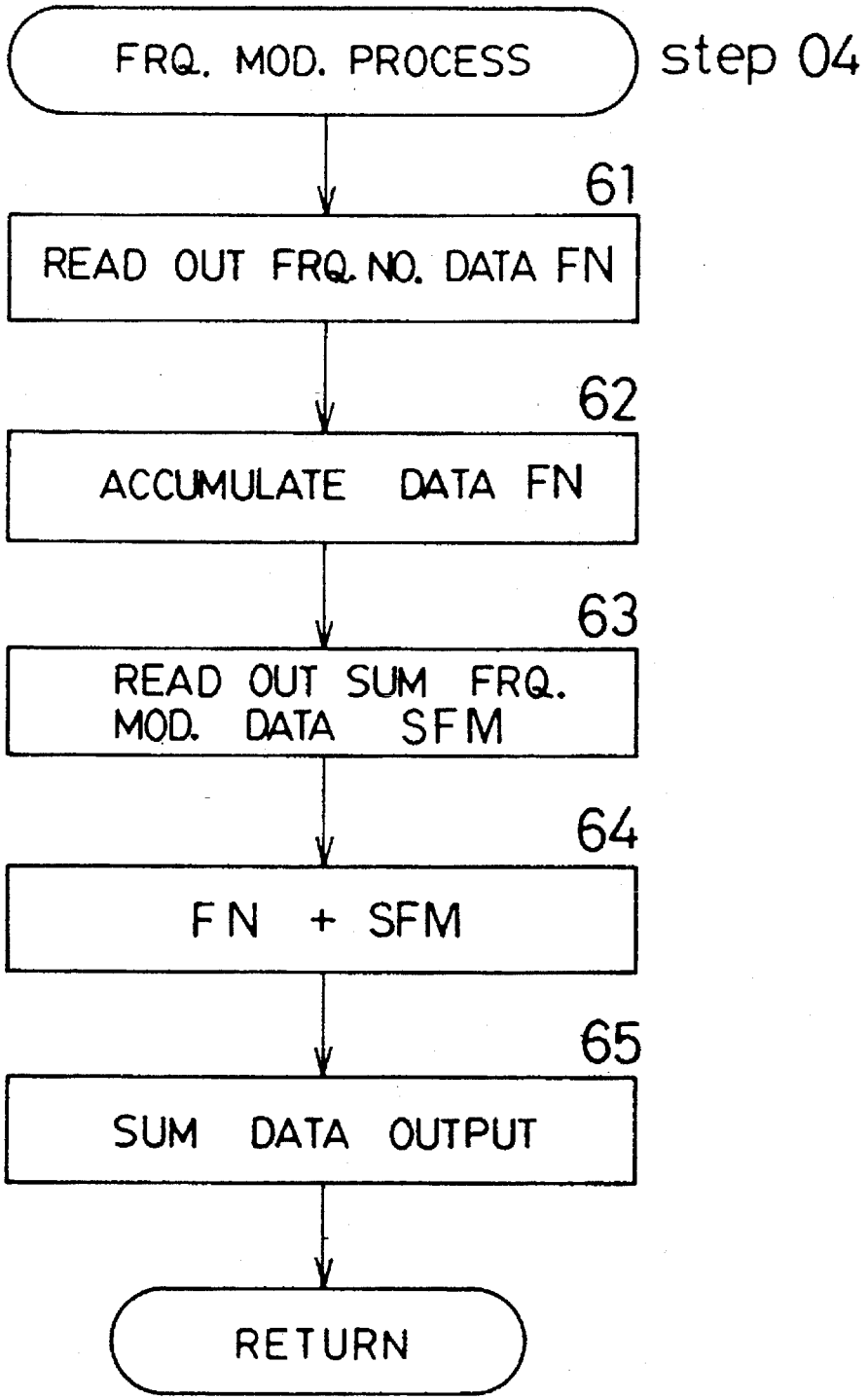
FIG. 8 is a flowchart showing the operation of frequency modulation in a step 04.

FIG. 8 is a flowchart showing the process of frequency modulation that is executed in the step 04. The frequency number data FN that has been written in the register FM1 of the data RAM 38 in the step 01, is read out to be set in the input- and output-buffers 35 and 36 (step 61). Further, the frequency number data FN from the output-buffer 36 is accumulated to the frequency number data FN from the input-buffer 35 in the adder 34 (step 62).

Then, the sum (synthesized) frequency modulation data SFM in the register MS1 of the data RAM 38 is read out (step 63) to be added in the adder 34 to the accumulated frequency number data AFN from the input-buffer 35 (step 64). The sum (synthesis) output of the adder 34 is written in the register FN2 of the data RAM 38 and also coupled through the interface 37 to the processing RAM 12 (step 65). The data supplied to the processing RAM 12 is only higher integral data in the data obtained by the calculation.

Thus, the tone waveform data TW having been stored in the processing RAM 12 is read out in a frequency modulated state. When writing the tone waveform data TW in the processing RAM 12, the data generated in the steps 61 to 65 may be supplied as Write address data. The steps 61 to 65 are repeated as shown in FIG. 4. Thus, the read address data RAD is accumulated and incremented in a step corresponding to the frequency number data FN. The accumulation of the frequency number data FN may be done in the frequency number accumulator 112 shown in FIG. 12.

9. Process of frequency modulation

Figure 9:
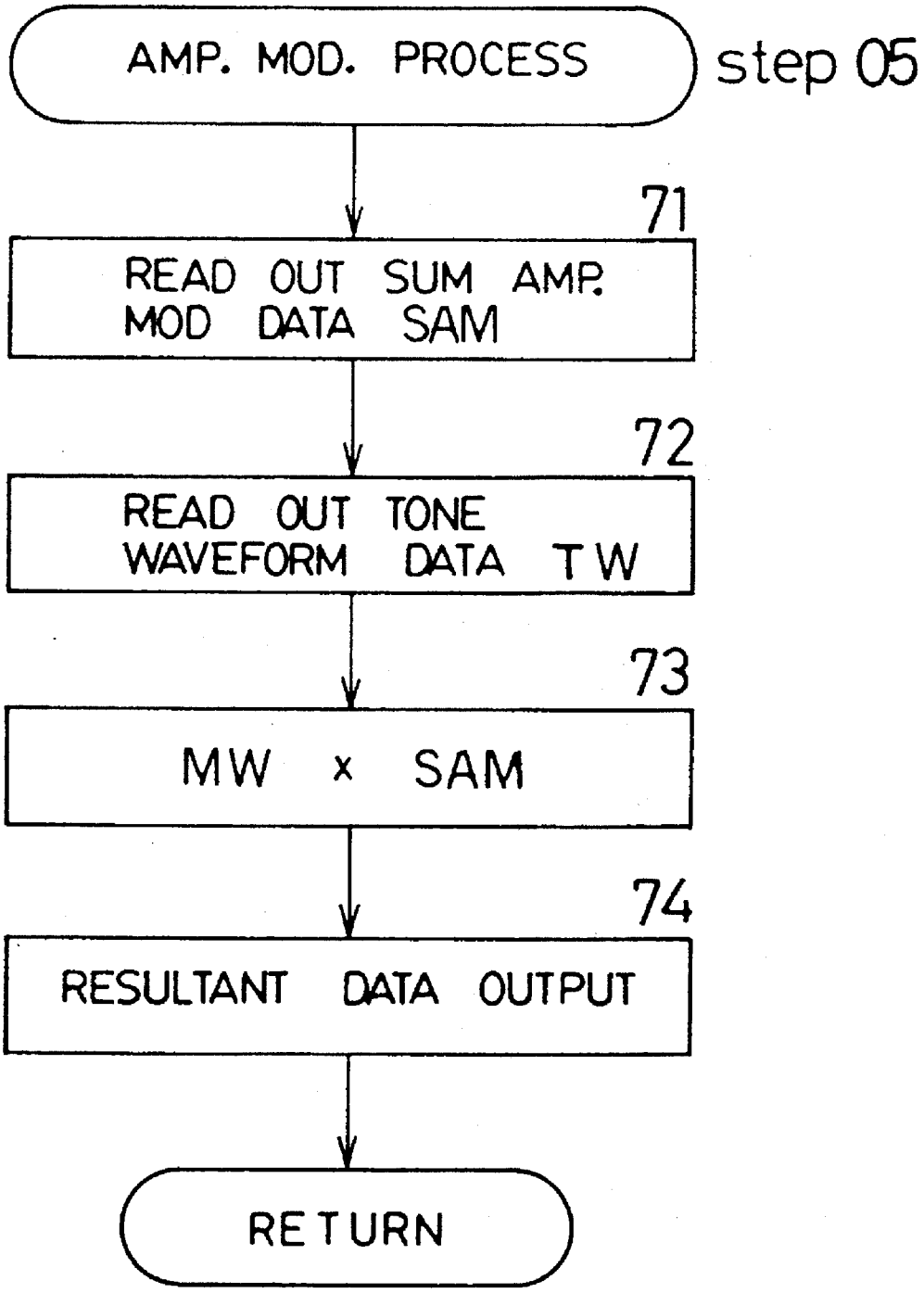
FIG. 9 is a flowchart showing the operation of amplitude modulation in a step 05.

FIG. 9 is a flowchart showing the process of frequency modulation that is executed in the step 05. First, the sum (synthesized) amplitude modulation data SAM in the register MS2 of the data RAM 38 is read out (step 71), and the tone waveform data TW read out in the step 65 is taken into the digital signal processor 11 (step 72). These data are multiplied and synthesized in the multiplier 33 (step 73), and the resultant data is set in the input- and output-buffers 35 and 36 and also supplied through the interface 37 to the D-A converter 15 (step Thus, the tone waveform data TW that has been frequency modulated is furthermore amplitude modulated and output. The above multiplying operation may be replaced with other calculations such as addition. The steps 71 to 74 are repeated as shown in FIG. 4.

Figure 10:
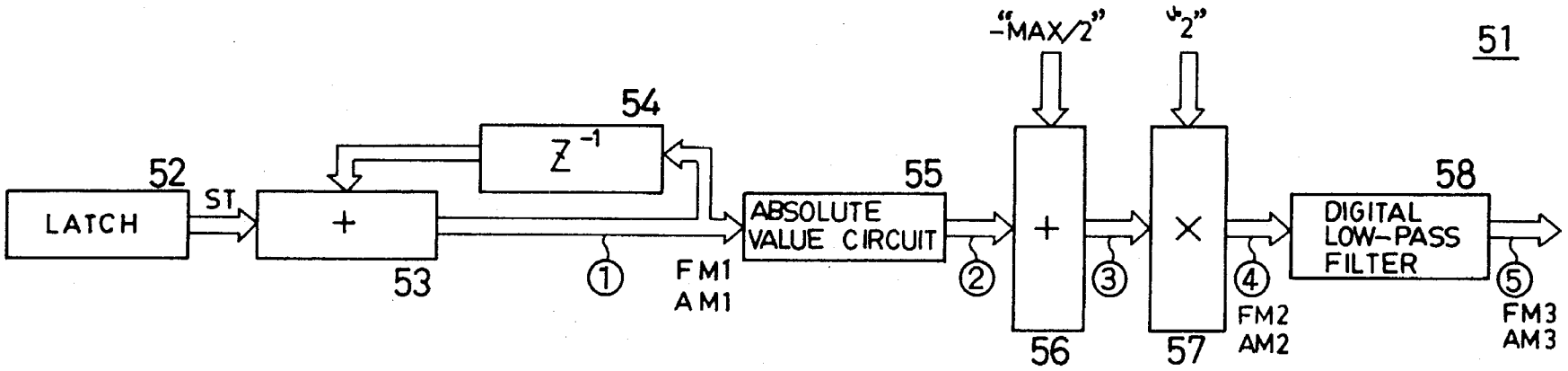
FIG. 10(*a*) is a circuit diagram showing a modulating circuit 51 for generating frequency modulation data FM and amplitude modulation data AM and FIG. 10(*b*) shows corresponding waveforms.
Figure 10:
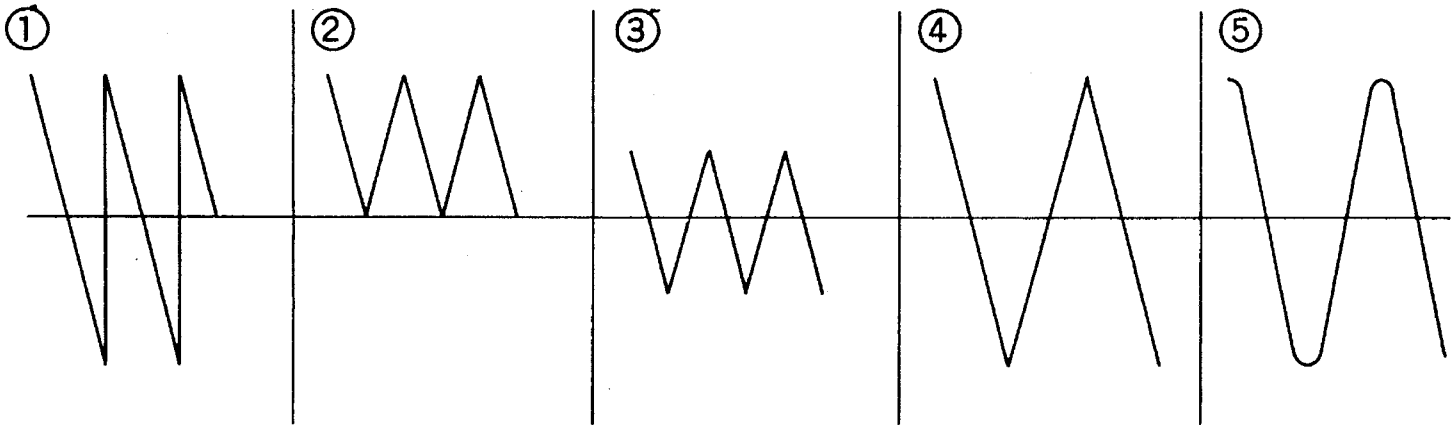

10. Modulating circuit 51 for generating frequency and amplitude modulation data FM and AM FIG. 10 (*a*) shows a modulating circuit 51 for generating frequency and amplitude modulation data FM1 to FM3 and AM1 to AM3, and FIG. 10(*b*) shows corresponding waveform. This modulating circuit 51 corresponds to the process in the steps 11 to 45. The step data ST that has been set in a latch 52 by the system CPU or the like, is fed back through an adder 53 and a delay circuit 54 to an adder 53. The step data ST thus is accumulated progressively to generate sawtooth wave modulation data FM1 and AM1.

An absolute circuit 55 takes the absolute values of the modulation data FM1 and AM1 to generate positive chopping wave modulation data M. The absolute circuit 55 includes exclusive or gate groups and an adder. Each bit data of the modulation data FM1 and AM1 is input to each exclusive OR gate group, and the most significant sign bit data of the modulation data FM1 and AM1 are input to all the exclusive OR gate groups. The modulation data Mr1 and AM1 are inverted or non-inverted according to the sign bit. In the adder 34, the most significant sign bit data are added, and in the inversion of the modulation data FM1 and AM1 correction by "+1" is done.

The positive chopping wave modulation data M is converted to small chopping wave modulation data M by addition of the data "–MAX/2" in the adder 56. The small chopping wave modulation data M is converted to chopping wave modulation data FM2, and AM2 with double the amplitude by being multiplied by "2" in a multiplier (or Shifter) 57. The chopping wave modulation data FM2 and AM2 are converted to sine wave modulation data FM3 and AM3 with their harmonic components cut out in a digital low-pass filter 58. It is possible to generate rectangular waves, waveforms obtained by synthesizing the above waves and other waveforms as the modulation data FM1 to FM3 and AM1 to AM3.

11. Weighting/modulating circuit 61

FIG. 11(*a*) and 11(*b*) shows a weighting/modulating circuit 61. The weighting/modulating circuit 61 corresponds to the process of the steps 51 to 74. The sawtooth, chopping and sine wave frequency modulation data FM1 to FM3 generated in the modulating circuit 51, are multiplied in multipliers 62 to 64 by frequency weighting data WT1 to WT3, and the resultant product data are additively synthesized in an adder 65, the sum (synthesized) data of which is set in a latch 66. This data set in this way is supplied as sum (synthesized) frequency modulation data SFM to the frequency number accumulator by the system CPU 5.

The sawtooth, chopping and sine wave amplitude modulation data AM1 to AM3 generated in the modulating circuit 51 are multiplied in multipliers 72 to 74 by amplitude weighting data WT4 to WT6, and the resultant product data are additively synthesized in an adder 75, the sum (synthesized) data of which is set in a latch 76. The data that is set in this way is supplied as sum (synthesized) amplitude modulation data SAM to a multiplier 78 by the system CPU 5. To the multiplier 78 tone waveform data TW is also input. The weighting data WT1 to WT6 are set in latches 81 to 86 by the system CPU 6 to be supplied to the multipliers 62 to 64 and 72 to 74.

The above adding synthesis may be replaced with other operational synthesis such as a multiplying synthesis, and the above multiplying synthesis may be replaced with other operational synthesis such as an adding synthesis. The weighting of the modulation data FM1 to FM3 and AM1 to AM3 may be done through bit shift corresponding to the weighting data WT1 to WT6, division, addition and subtraction, operations based on certain formulas, average calculation, a process with some bits as a high bit group and the other bits as a low bit group, etc., as well as the multiplication by the weighting data WT1 to WT6.

The frequency weighting data WT1 to WT6 are stoned in the system ROM 7 as values which change with the lapse of time, and by an interrupt process executed for evenly constant period by the system CPU 5 they are read out and supplied to the digital signal processor 11. However, it is possible as well to stone the data WT1 to WT6 in the processing R0M 13 and transfer it to the coefficient RAM 39 in the initialization process in the step 01.

The frequency weighting data WT1 to WT6 may be made fixed in value. Further, it is possible to generate the weighting data WT1 to WT6 in an operational process similar to that in the steps 11 to 45. Further, the accumulation of the frequency number data FN may be executed in a frequency number accumulator 112 shown in FIG. 12. Further, the weighting data WT1 to WT6 may be stoned in a fluctuation data memory 321 in a fluctuation data generator 211 shown in FIG. 12 to 14 to be read out on a time division basis of not on any time division basis.

12. Overall circuit of second embodiment

FIGS. 12 to 14 show a second embodiment. FIG. 12 shows the overall circuit. To a frequency number accumulator 112, frequency number data FN1 to FN3 at the center of variations (i.e., average value) on frequency axis corresponding to the passage of a first to a third format peak point of a certain musical tone MT with the lapse of time, are supplied in accordance with channel assignment (tone number TN). In a fluctuation data generator 111, frequency modulation data FM1 to FM3 on frequency axis in ratios corresponding to the elapsed time are stored in correspondence to the frequency number data FN1 to FN3, and they are read out according to the channel assignment (tone number TN).

Further, to an envelope generator 114, envelope waveform data EN at the center of variations (average value) on amplitude axis corresponding to a first to a third formant peak point of the musical tone MT with the lapse of time, are supplied according to channel assignment (tone number TN). In a fluctuation data generator 211, amplitude modulation data AM1 to AM3 on amplitude axis in ratios corresponding to variations of the individual formant peak points with the lapse of time are stored in correspondence to the individual envelope waveform data EN, and are similarly read out according to channel assignment (tone number TN).

The individual tone waveform data TW that have been read out from the tone waveform memory 113 according to the frequency number data FN1 to FN3 and frequency modulation data FM1 to FM3, are multiplied in a multiplier 81 by the above amplitude modulation data AM1 to AM3 in respective time divisions, and the resultant product data are multiplied in a multiplier 115 by the above envelope waveform data EN and is accumulated in an accumulator 116.

It is possible that envelope waveform data EN1 to EN3 on an amplitude axis corresponding to variations of the individual formant points with the lapse of time are stored in the fluctuation data generator 211 and read out according to channel assignment (tone number TN). Further, the formant peak points for a tone TM that is processed in this embodiment may be two or less or four or more in number. Further, it is possible that the data that is read out in the step 63 may not be the sum (synthesized) frequency modulation data SFM but may be the frequency modulation data FM1 to FM3 so that the the frequency modulation process in the step 04 (61 to 65) may be repeated for each of the frequency modulation data FM1 to FM3 for reading a plurality of frequency modulated tone waveform data TW, which may be subjected to the amplitude modulation process in the step 05 (71 to 74) or sent through the weighting/modulating circuit 61 before the additive (or other operational) synthesis. By so doing, it is possible to obtain frequency and amplitude modulations along formant peak point changes.

In this case, the frequency modulation data FM1 to FM3 correspond to the formant peak point changes on the frequency axis. The amplitude modulation process in the step 05 thus is executed according to a plurality of amplitude modulation data AM1 to AMS. The amplitude modulation data AM1 to AMS in this case correspond to formant peak point changes on the amplitude axis. In this case, fluctuation data FL is read out from the fluctuation data memory 321 in the fluctuation data generator 211 on a time division basis and processed as the frequency and amplitude modulation data FM1 to FM3 and AM1 to AM3. Further, the processing RAM 12 may be replaced with the tone waveform memory 113 shown in FIG. 12, and it is possible to omit the process in the step 03.

13. fluctuation data generator 211

FIG. 13 shows the fluctuation data generator 211. The fluctuation data generator 211 has a fluctuation data memory 321, in which a plurality of fluctuation data FL are stored according to the tone number data TN. The fluctuation data FL is read out according to the progress of envelope waveform data generation. As shown in FIG. 14, the fluctuation data FL commences to be read out subsequent to a key-"on", that is, from the start of the attack phase ("00") of the envelope waveform. Then in the decay phase ("01") the portion between the loop top LT and the loop end LE is read out repeatedly. Then, the loop end LE and following data are read out subsequent to the key-"off" till the end of sounding, i.e., in the release phase ("01"). The fluctuation data FL is amplitude data which is sampled at various points of the fluctuation waveform. In some cases, it is compressed and then stored as shown in U.S. Pat. Ser. No. 09/433,015.

The tone number data TN which has been supplied by the CPU (not shown), is converted through a latch 322 to a fluctuation ROM 323 to start address data ST, loop top address data LT and loop end address data LE. In the fluctuation R0M 323, the start, loop top and loop end address data ST, LT and LE in the data memory 321 that correspond to each tone number data TN are stored.

The Start address data ST is coupled through a selector 324 to be input to an address register 325. In the address register 325, address data for 16 channels are stored to be successively shifted to be output according to a channel clock signal CH ϕ. The period of the channel clock signal CH ϕ is equal to the channel time of each channel.

The start address data ST that is output is supplied to the fluctuation data memory 321 to read the fluctuation data FL. This start address data ST is incremented by "+1" in the adder 326 and then fed back through a selector 327 and the selector 324 noted above to the address register 325. In this way, the start address data ST is progressively incremented, and the fluctuation data FL is read out from the start.

The data to be added in the adder 326 may be less or greater than "1". If the data is "1" or less than "1", the address data that is given to the fluctuation data memory 321 is higher of the address data in the address register 325. To the selector 324 an on-event signal ONEV from the envelope generator 114 is supplied as a select signal, and at the time of a key-"on" the start address data ST is input to the address register 325.

The loop top and loop end address data LT and LE from the fluctuation ROM 323 are input through a selector 328 to a loop register 329. In the loop register 329 loop top and loop end address data LT and LE for 16 channels are stored. These data are progressively shifted to be output according to the channel clock signal CH ϕ.

The loop top and loop end address data LT and LE that are output are input through the selectors 330, 327 and 324 to the address register 325. The loop end address data LE output is fed back through the selector 328 to the address register 325. To the selector 328 the on-event signal 0NEV from the envelope generator 114 is supplied as a select signal, and at the time of a Key-"off" the loop top and loop end address data LT and LE are input to a loop register 329.

The loop end address data LE from the loop register 329 and read address data from the address register 325 are supplied to a comparator 331. When the read address data exceeds the loop end address data LE, a detection signal is supplied as a select signal through an AND gale 332 and an OR gate 333 to the selector 327. Thus, the loop top address data LT is input to the address register 325, and the read address data is incremented from the loop top address data LT. When the fluctuation data FL being read out reaches the loop end LE, the reading jumps to the loop top LT for repeated reading from the loop top LT to the loop end LE.

Higher bit data of the phase data PH is input through an inverter 334 to the AND gate 332. Thus, the jumping of the read address data from the loop end LE to the loop top LT is not done in the release ("10") and is done in the attack ("00") or decay ("01").

Further, a coincidence signal is output from the envelope generator 14 at each phase end in the envelope waveform. The coincidence signal ag is provided as a select signal through the AND gate 335 and 0R gate 333 to the selector 327. Double bit data of the phase data PH is input to a NAND gate 336, and the output thereof is input to the AND gate 335. Thus, at the end of the attack phase, jumping to the loop top LT is done even when the loop top LT has not been reached by the read address data from the address register 325.

Furthermore the off-event signal OFFEV from the envelope generator 14 is supplied as a select signal to the selector 330. Thus, in the attack or decay phase, jumping to the loop end LE is done at the start of the release phase even when the loop end LE has not been reached by the read address data from the address register 825.

The read time from the start of the fluctuation data FL in the fluctuation data memory 321 till the lop top LT coincides with the attack phase time. However, it may not be coincident. In this case, jumping to the loop end the is done irrespective of whether the read address data from the address register 325 exceeds the loop end LE or not.

Further, it is possible to arrange such that the read address data does not jump to the loop top LT in the transition from the attack to the decay phase. In this case, the selector 330 is omitted, only the loop top address data LT is supplied to the selector 327, the detection signal from the comparator 331 is output through the OR gate 333 to the selector 327, and the AND gate 332 and inverter 334 are omitted. In addition, the envelope waveform may not have the decay phase and may consist of only the attack and release phases.

Furthermore, it is possible to arrange such that the read address data does not jump to the loop end LE in the transition from the decay phase to the release phase. In this case, the selector 330 is omitted, and only the loop top address data LT is supplied to the selector 327. Here, the envelope waveform may not have the release phase and may consist of only the attack and decay phases.

Further, the interval between the loop top LT and loop end LE in the fluctuation data FL may correspond not to the decay phase but to the release phase. In this case, the interval from the start of the fluctuation data FL till the loop top LT is extended. Also, the detection signal from the comparator 331 is output through the OR gate 333 to the selector 327, and the off-event signal OFFEV is output through the OR gate 333 to the selector 327. The AND gates 332 and 335, NAND gate 336 and inverter 334 are omitted.

The embodiments described above are by no means limitative, and various changes and modifications are possible without departing from the scope of the invention. For example, the fluctuation data FL may correspond to musical factor data, such as envelope waveform data EN, volume data, touch data TC, filter characteristic data, etc. In this case, the fluctuation data FL from the fluctuation data generator 211 is synthesized with the envelope waveform data EN from the envelope register 47 in the envelope generator 114 or speed or target data of the envelope waveform data EN. Further, the fluctuation data FL from the fluctuation data generator 211 is supplied to the multiplier 115. Further, the touch data TC in an assignment memory (not shown) is supplied by the CPU together with the tone number data TN and key number data KN to the frequency number accumulator 112, envelope generator 114 and fluctuation data generator 211, and the fluctuation data FL is synthesized with the touch data TC thus supplied for setting the resultant data in the latch 322, frequency number accumulator 112 and envelope generator 114.

Further, while the plurality of fluctuation data FL that are stored in the fluctuation data memory 321 have been made to correspond to respective tone number data TN, it is also possible to store each of them for each musical factor, such as each touch data TC, each key number data KN (octave data), etc. Further the touch data TC and key number data KN (octave data) are supplied in place of the tone number data TN to the frequency number accumulator 112, fluctuation data generator 211 and envelope generator 114. In this way, the fluctuation data FL can be changed for each musical factor such as each tone color, each touch response characteristic, each tone pitch group, etc.

The plurality of fluctuation data FL may be selected by operating the switches in the panel switch group 3 or switches for selecting different kinds of effects. In this case, data obtained by switch operation is used in lieu of the tone number data TN.

Further, for the fluctuation data FL stored in the fluctuation data 321, if the fluctuation data memory 321 has sufficiently large storage capacity, it is possible to omit the loop top LT and loop end LE and not to make the storage and repeated reading of all the fluctuation data FL from the start till the end of sounding.

Furthermore, it is possible to execute the process of the frequency or amplitude modulation with respect to a plurality of tones, on as a time division process. In this case, the steps 07, to 05 (i.e., steps 11 to 74) are repeatedly executed for each tone waveform data TW. In addition, the registers MW1 to MW3, W1 to W6, MS1, MS2, FN1 and FN2 are provided for each tone, and shift registers corresponding in number to the number of channels are added in the modulating circuit 51 and weighting/modulating circuit 61. In this case, the processing RAM 12 may be replaced with the tone waveform memory 113 in FIG. 12.

Further, it is possible to generate the tone waveform data TW by an operational process. In this case, the digital signal processor 11 executes a high speed process which is the same as the step 02 (i.e., steps 11 to 45). Thus, like the process of generating the frequency and amplitude modulation data FM1 to FM3 and AM1 to AM3, a process of generating the tone waveform data TW is executed. This process may be carried out on a time division basis.

Furthermore, while the frequency and amplitude modulation data FM1 to FM3 and AM1 to AM3 have been generated by operational processes, it is also possible that these data may be stored in and read out from a memory. In this case, the fluctuation data generator 211 (i.e., fluctuation data memory 321) shown in FIG. 12 is used. The process of the steps 03 to 05 (i.e., steps 51 to 74) is executed with respect to the read-out frequency and amplitude modulation data FM1 to FM3 and AM1 to AM3.

The sum (synthesized) frequency and amplitude modulation data SFM and SAM that are generated in the above way may be based on fluctuation control on such musical factor data as envelope data, filter characteristic data. volume data, etc. In this case, the generated frequency and amplitude modulation data FM1 to FNB and Al to A3 are synthesized with the envelope waveform data EN from the envelope register in the envelope generator 114 shown in FIG. 12 or speed or goal data of the envelope waveform data EN. The generated frequency and amplitude modulation data SFM and SAM are supplied to the multiplier 115 shown in FIG. 12.

Further, it is possible to generate the above weighting data WT1 to WT6 or frequency or amplitude modulation data FM1 to FM3 or AM1 to AM3 for each musical factor such as tone number data, touch data, key number data KN (N (i.e., octave data), etc. In this case, the touch data TC and key number data KN (octave data) are supplied in lieu of the tone number data TN to the frequency number accumulator 112, fluctuation data generator 211 and envelope generator 114. This has the effect that the fluctuation data FL is changed for each musical factor such as tone color, touch response characteristic, a range of tone pitch, etc.

Furthermore, the plurality of weighting data WT1 to WT6 or frequency or amplitude modulation data FM1 to FM3 or AM1 to AM3 may be selected with the operation of switches in the panel switch group 3 for instance operation of switches for selecting different kinds of effects. In this case, the data obtained with the switch operation is used in lieu of the tone number data TN.

What is claimed is:

1. An apparatus for producing fluctuations in sound for an electronic sound system comprising:

sound data generation means for generating sound data;

speed information generation means for generating speed information for determining the speed of generation of sound data generated by said sound data generation means;

sound data generation speed control means for controlling the speed of generation of sound data generated by said sound data generation means according to speed information generated by said speed information generation means;

frequency modulation information generation means for generating a plurality of parallel pieces of frequency modulation information for changing the sound data generation speed controlled by said sound data generation speed control means;

weighting means for independently weighting a plurality of pieces of frequency modulation information generated by said frequency modulation information generation means;

modulation synthesizing means for synthesizing the plurality of weighted frequency modulation information having been weighted independently by said weighting means; and sound synthesizing means for synthesizing frequency modulation information synthesized by said modulation synthesizing means with speed information generated by said speed information generation means.

2. An apparatus for producing fluctuations in sound for an electronic sound system comprising:

sound data generation means for generating sound data;

speed information generation means for generating speed information for determining the speed of generation of sound data by said sound data generation means;

sound data generation speed control means for controlling the speed of generation of sound data generated by said sound data generation means according to speed information generated by said speed information generation means;

frequency modulation information generation means for generating a plurality of parallel pieces of frequency modulation information for changing the sound data generation speed controlled by said sound data generation speed control means;

frequency information synthesizing means for synthesizing the individual pieces of frequency modulation information generated by said frequency modulation information generation means with individual pieces of speed information generated by said speed information generation means;

weighting means for independently weighting individual pieces of sound data generated by said sound data generation means according to individual pieces of speed information synthesized by said frequency information synthesizing means under control of said sound data generation speed control means; and sound synthesizing means for synthesizing individual pieces of weighted sound data having been weighted by said weighting means.

3. The apparatus for producing fluctuations in sound for an electronic sound system according to one of claims 1 and 2, wherein speed information generated by said speed information generation means consists of a plurality of pieces of speed information having different values.

4. The apparatus for producing fluctuations in sound for an electronic sound system according to one of claims 1 and 2, wherein said weighting means generates a plurality of different pieces of weighting data independent of one another, said individual weighting data being changed with the lapse of time, said changed individual weighting data being synthesized with a plurality of pieces of frequency modulation information generated by said frequency modulation information generation means.

5. The apparatus for producing fluctuations in sound for an electronic sound system according to one of claims 1 and 2, wherein said sound synthesizing means effects synthesis by changing the levels of individual sound data with the lapse of time.

6. The apparatus for producing fluctuations in sound for an electronic sound system according to one of claims 1 and 2, wherein said frequency modulation information generation means generates three or more parallel pieces of frequency modulation information.

7. The apparatus for producing fluctuations in sound for an electronic sound system according to one of claims 1 and 2, wherein said frequency modulation information is fluctuation data.

8. The apparatus for producing fluctuations in sound for an electronic sound system according to claim 7, wherein said fluctuation data is generated in accordance with the progress of generation of envelope waveform data.

9. The apparatus for producing fluctuations in sound for an electronic sound system according to claim 8, wherein the generation of said fluctuation data is switched according to the switching of the attack, decay, sustain or release phase of envelope waveform data.

10. The apparatus for producing fluctuations in sound for an electronic sound system according to claim 7, wherein said fluctuation data is synthesized with musical effect data.

11. The apparatus for producing fluctuations in sound for an electronic sound system according to claim 7, wherein said fluctuation data has a repeat interval, the generation of the fluctuation data being repeated in said repeat interval.

12. The apparatus for producing fluctuations in sound for an electronic sound system according to claim 7, wherein said fluctuation data is stored for each musical factor such that fluctuation data corresponding to a designated musical factor is read out.

13. An method of producing fluctuations in sound for an electronic sound system comprising the steps of:

(A) generating sound data;

(B) generating speed information for determining the speed of generation of sound data generated in said step (A);

(C) controlling the speed of generation of sound data generated in said step (A) according to speed information generated in said step (B);

(D) generating a plurality of parallel pieces of frequency modulation information for changing the sound data generation speed controlled in said step (C);

(E) independently weighting the plurality of pieces of frequency modulation information generated in said step (D);

(F) synthesizing the plurality of weighted pieces of frequency modulation information having been weighted in said step (E); and (G) synthesizing frequency modulation information synthesized in said step (F) with speed information generated in said step (B).

14. An method of producing fluctuations in sound for an electronic sound system comprising the steps of:

(A) generating sound data;

(B) generating speed information for determining the speed of generation of sound data generated in said step (A);

(C) controlling the speed of generation of sound data in said step (A) according to speed information generated in said step (B);

(D) generating a plurality of parallel pieces of frequency modulation information for changing the sound data generation speed controlled in said step (C);

(E) independently synthesizing individual pieces of frequency modulation information generated in said step (D) with individual pieces of speed information generated in said step (A);

(F) independently weighting individual pieces of sound data generated in said step (A) according to individual pieces of speed information synthesized in said step (E) under control in said step (C); and (G) synthesizing individual pieces of sound data weighted in said step (F).

15. The method of producing fluctuations in sound for an electronic sound system according to one of claims 13 or 14, wherein the speed information generated in said step (B) consists of a plurality of pieces of speed information having different values.

16. The method of producing fluctuations in sound for an electronic sound system according to one of claims 13 of 14, wherein said weighting means generates a plurality of different pieces of weighting data independent of one another, said individual pieces of weighting data being changed with the lapse of time, said changed pieces of weighting data being synthesized with a plurality of pieces of frequency modulation information generated by said frequency modulation information generation means.

17. The method of producing fluctuations in sound for an electronic sound system according to one of claims 13 and 14, wherein said synthesis in said step (G) is effected with the levels of individual pieces of sound data changed with the lapse of time.

18. The method of producing fluctuations in sound for an electronic sound system according to one of claims 13 and 14, wherein in said step (D) three of more parallel pieces of frequency modulation information are generated.

19. The method of producing fluctuations in sound for an electronic sound system according to one of claims 13 and 14, wherein said frequency modulation information is fluctuation data.

20. The method of producing fluctuations in sound for an electronic sound system according to claim 19, wherein said fluctuation data is generated according to the progress of generation of envelope waveform data.

21. The method of producing fluctuations in sound for an electronic sound system according to claim 20, wherein the generation of said fluctuation data is switched according to the switching of the attack, decay, sustain and release phases of envelope waveform data.

22. The method of producing fluctuations in sound for an electronic sound system according to claim 19, wherein said fluctuation data is synthesized with musical factor data.

23. The method of producing fluctuations in sound for an electronic sound system according to claim 19, wherein said fluctuation data has a repeat interval, the generation of said fluctuation data being repeated in said repeat interval.

24. The method of producing fluctuations in sound for an electronic sound system according to claim 19, wherein fluctuation data are stored corresponding to musical factors, fluctuation data corresponding to a designated musical factor is read out.

* * * * *